US006007293A

United States Patent [19]

Roudebush

[11] Patent Number: 6,007,293

[45] Date of Patent: Dec. 28, 1999

[54] SIGNATURE BUNDLE INVERTER

[75] Inventor: Steven R. Roudebush, Middleton, Wis.

[73] Assignee: Webcrafters, Inc., Madison, Wis.

[21] Appl. No.: 09/045,748

[22] Filed: Mar. 20, 1998

[51] Int. Cl.[6] ..... B65G 7/000

[52] U.S. Cl. ..... 414/758; 414/772

[58] Field of Search ..... 414/790.8, 758, 414/772

[56] References Cited

U.S. PATENT DOCUMENTS

| | | | |
|---|---|---|---|
| 2,862,629 | 12/1958 | Aberle | 414/772 X |
| 4,183,704 | 1/1980 | Steinhart . | |
| 4,657,465 | 4/1987 | Aoki . | |
| 4,725,180 | 2/1988 | Kasamatsu et al. . | |
| 5,209,629 | 5/1993 | Rasmussen | 414/772 |
| 5,282,716 | 2/1994 | Prim et al. . | |
| 5,353,576 | 10/1994 | Palamides et al. . | |
| 5,392,700 | 2/1995 | Kleinhen . | |

FOREIGN PATENT DOCUMENTS

| | | | |
|---|---|---|---|
| 60-2550 | 1/1985 | Japan | 414/758 |

*Primary Examiner*—Janice L. Krizek
*Attorney, Agent, or Firm*—Lathrop & Clark LLP

[57] ABSTRACT

A signature bundle inverting machine having a table for movement between a bundle receiving position and a rotating position for inverting bundles prior to transport to a binding machine. The table may also include a hoist-accessible position that permits the bundles to be removed from the table by a hoist or other lifting mechanism to reduce manual labor.

10 Claims, 7 Drawing Sheets

SIGNATURE BUNDLE INVERTER

FIELD AND BACKGROUND OF THE INVENTION

This invention relates generally to signature folders, stackers, and bundlers used in the printing industry that produce heavy bundles of signatures ready to be bound together to form books. More particularly, the present invention relates to a signature bundle inverter that inverts a heavy bundle of signatures from a stacking machine prior to delivery of the bundle to a binding machine so that the signatures are in a proper orientation for use in the binding machine.

In the publication industry books are manufactured using signatures which are a collection of four, eight, sixteen, or thirty two pages folded together and bound into books. With some existing stacking machines, signatures are formed and deposited on a receiving rack in a position that is inverted from a position that can be used in a binding machine. Consequently, a bundle of signatures must be inverted prior to being transported to a binding machine. Typically, the inversion process is done by "pocket feeders" in a bindery which must flip a bundle of signatures a lift at a time. Worker injuries, downtime, and high insurance costs all result from repetitive manual inversion of signature bundles. Numerous machines are used to handle bundles of signatures (see for example: Steinhart, U.S. Pat. No. 4,183,704; Kasamatsu et al., U.S. Pat. No. 4,725,180; Palamides, U.S. Pat. No. 5,353,576; and Kleinhen, U.S. Pat. No. 5,392,700). None of the prior signature handling machines receives vertical bundles of signatures directly from a stacking machine and inverts them to a position usable in a binding machine.

Thus, there is needed a signature bundle inverter that minimizes the use of manually lifting signature bundles and inverts the bundles quickly and efficiently for proper orientation prior to delivery to a binding machine.

SUMMARY OF THE INVENTION

To reduce the potential worker injuries and improve job conditions for printing plant employees, the present invention receives bundles of signatures and inverts them for appropriate orientation for use in a binding machine without the need for workers lifting the heavy bundles or inverting the signatures a lift at a time. In accordance with the present invention, there is provided a signature bundle inverter having: a frame; a table pivotably mounted on the frame for movement between a first or upright bundle receiving position and a second or horizontal bundle rotation position, and having a bundle end support and a bundle side support; an actuator for pivoting the table between the first position and the second position; and a table pivot for rotating the bundle side support of the table 180 degrees relative to the bundle end support. Preferably, the table tilts to a third position, such as vertical, so that a hoist can readily access the inverted bundles for transport with a minimum of manual labor. The signature bundle inverter table bundle end support may include a plurality of bundle end rollers and the bundle side support may include a plurality of bundle side rollers.

Further, the table bundle side support may include a first or reciprocating portion operatively mounted to the frame for movement between a first position and a second position; a second or rotating portion that is co-planar with the first portion in the first position and operatively mounted to the frame for rotating movement with the first table portion in its second position; and an actuator for moving the first table portion between the first position and second position.

The signature bundle inverter table pivot preferably includes: a rack and pinion mechanism having a pneumatic cylinder and a reciprocating piston, a rack fixed to the reciprocating piston, and a pinion fixed to the table and meshed to the rack for rotation relative to the frame when the piston reciprocates. The signature bundle inverter actuator may include a pneumatic cylinder pivotably mounted to the frame, and to the bundle side support at a distance spaced from a pivot point between the table and frame.

The signature bundle inverter may also include a bundle end displacement ram operatively mounted to the table bundle end support to move a bundle of signatures away from the bundle end support to provide clearance when the bundle side support is rotating.

Another signature bundle inverter in accordance with a present invention includes: a frame; a table pivotably mounted to the frame at a pivot point for movement between a first upright position and a second horizontal position, and having a bundle end receiving portion, a reciprocating portion, and a rotatable portion; an actuator mounted to the frame and the table for pivoting the table between the first upright position and the second horizontal position; a bundle end displacement ram operatively mounted to the table bundle end receiving portion for movement between a bundle receiving position and a bundle displaced position; and a pivoting mechanism operatively mounted to the rotatable portion. Preferably, the table has a third hoist-accessible position that permits a bundle to be removed from the machine with a minimum of manual labor.

This signature bundle inverter may have a bundle end receiving portion that includes a number of bundle end support rollers and the reciprocating and rotating portions may include a number of side support rollers.

The signature bundle inverter reciprocating portion is preferably operatively mounted to the frame for movement between a first position co-planar with the rotating portion, and a second position that provides clearance for the rotating table portion as it rotates.

Further, the signature bundle inverter reciprocating portion may include an actuator for moving the reciprocating portion between the first position and the second position. The actuator may include a pneumatic cylinder pivotably mounted between the frame and table at a point spaced apart from the frame and table pivot point and the bundle end displacement ram may include a cylinder that pushes the bundle away from the bundle end support to provide clearance when the rotating table portion is rotating. The pivoting mechanism preferably includes a rack and pinion, wherein the rack includes a pneumatic cylinder fixed to the reciprocating receiving portion having a reciprocating piston and the rack is fixed to the pneumatic reciprocating cylinder piston. With this arrangement the pinion is fixed to the second rotatable portion and meshed with the rack so that the rack and rotating table portion rotate when the piston reciprocates.

BREIF DESCRIPTION OF THE DRAWINGS

DETAILED DESCRIPTION OF THE DRAWINGS

Figure 1:
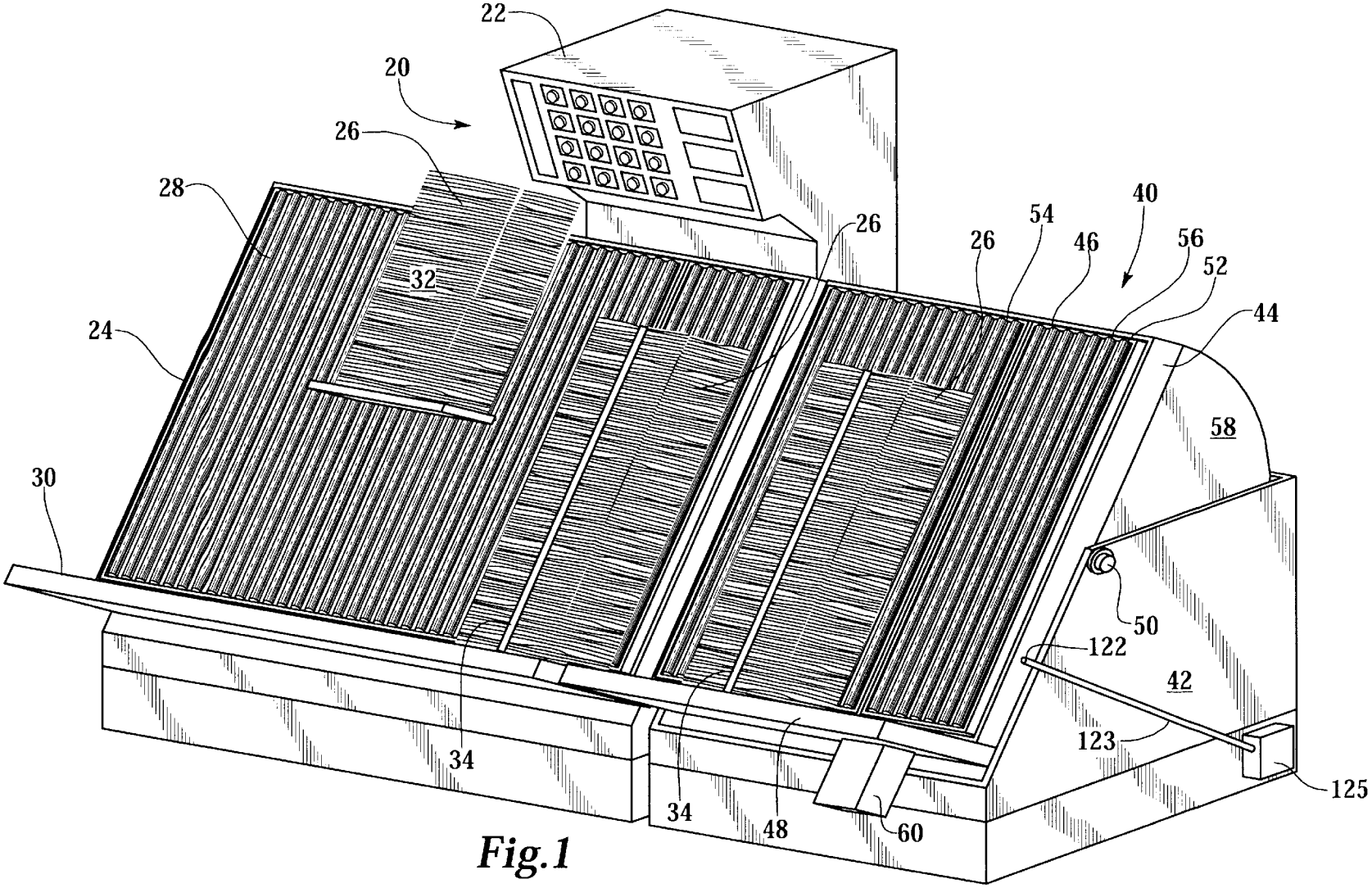
FIG. 1 is a perspective view of a stacking machine and a signature bundle inverting machine in accordance with the present invention.

To the extent practical, the same reference numerals will be used to identify the same or similar item in each of the figures described below. Illustrated generally in FIG. 1 is a signature stacking machine 20 having a control panel 22 and a receiving rack 24 for receiving signature bundles 26. The receiving rack 24 has generally upright rollers 28 for supporting a side of the signature bundles 26 and a base 30 for supporting an end of the signature bundles 26. The base 30 typically includes a number of support rollers (not illustrated) so that signature bundles 26 can be moved from side to side along the rack 24 with a relatively light push. As the signature bundles 26 are received from the signature stacking machine 20, the signatures 26 are in a reverse order from that which can be used in the binding machine. Therefore, to be used in a binding machine, the signature bundles 26 must be inverted.

To minimize manual labor to invert signature bundles 26, a signature bundle inverting machine 40 in accordance with the present invention is positioned adjacent to the signature stacking machine receiving rack 24. The signature bundle inverting machine 40 includes: a frame 42, a tilting table 44, a bundle side support portion 46, and a bundle end support portion 48. The tilting table 44 is joined to the frame 42 at a pivot shaft 50. The bundle side support portion 46 preferably includes a number of bundle side support rollers 52 in general alignment with the upright rollers 28 of the receiving rack 24 when the tilting table 44 is an upright position. The bundle end support 48 also preferably includes a number of rollers 53 (FIGS. 4 to 7, 14 and 15) in general alignment with the receiving rack base 30 when the tilting table 44 is in the upright position.

The upright position for the tilting table 44 can be any orientation that aligns with a receiving rack 24 on a signature stacking machine 20 such that a signature bundle 26 can be moved easily from the stacking machine receiving rack 24 to the tilting table 44, preferably without manual lifting. Thus, this upright position is any bundle receiving position regardless of whether it is vertical, slanted at 60 degrees as illustrated, or even horizontal. With the arrangement depicted in FIG. 1, the signature bundles 26 need only be pushed from one machine to the other along rollers that reduce resistance.

The tilting table 44 bundle side support portion 46 is divided into two primary components. The first component is illustrated on the left side of the inverting machine 40 and is referred to generally as a reciprocating table portion 54. On the right side of the inverting machine 40 is a rotating table portion 56. The tilting table 44 also includes an arcuate plate 58 that blocks a potential pinch point that can develop between the tilting table 44 and the frame 42 when the tilting table 44 pivots from the upright position as illustrated to a horizontal position, as described below. Also illustrated on the signature bundle inverting machine 40 is a bundle end displacement ram 60 that will be described in detail below.

Figure 2:
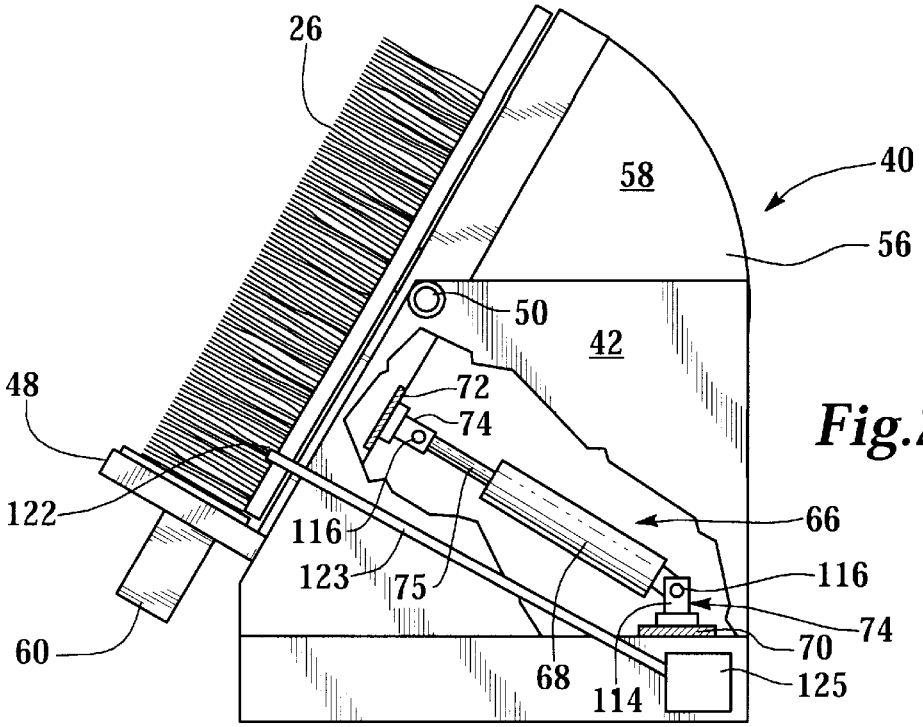
FIG. 2 is a side elevation view of a signature bundle inverter in the upright position with its frame partially broken away to reveal a pneumatic cylinder actuator mechanism.
Figure 3:
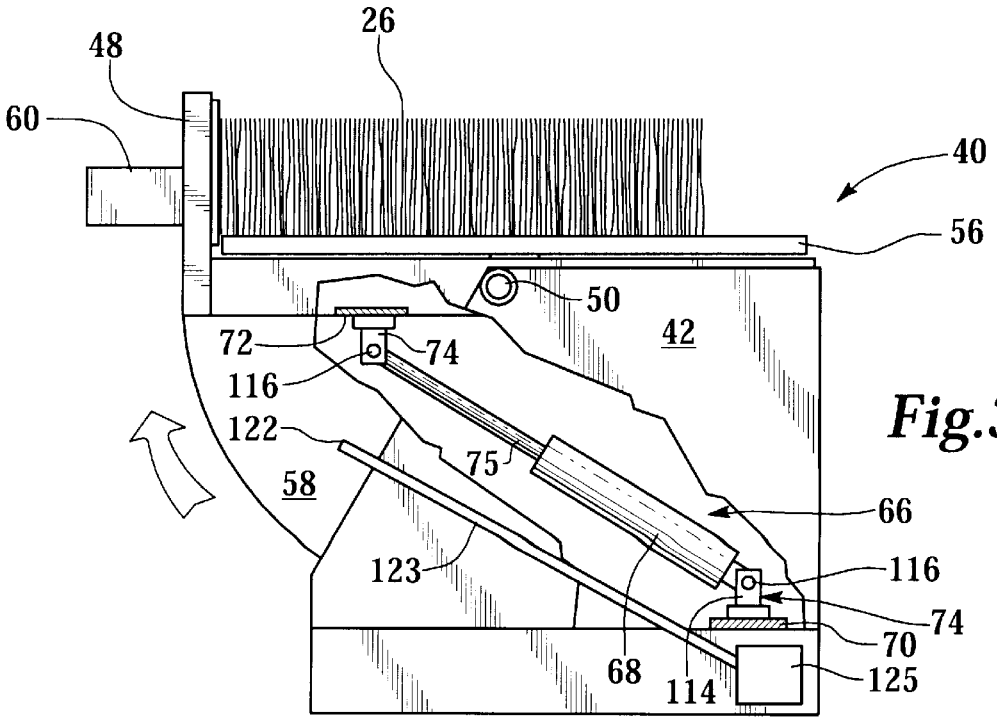
FIG. 3 is a side elevation view of the signature or bundle inverter in a tilted position with its frame partially broken away to reveal the pneumatic cylinder actuator mechanism.
Figure 4:
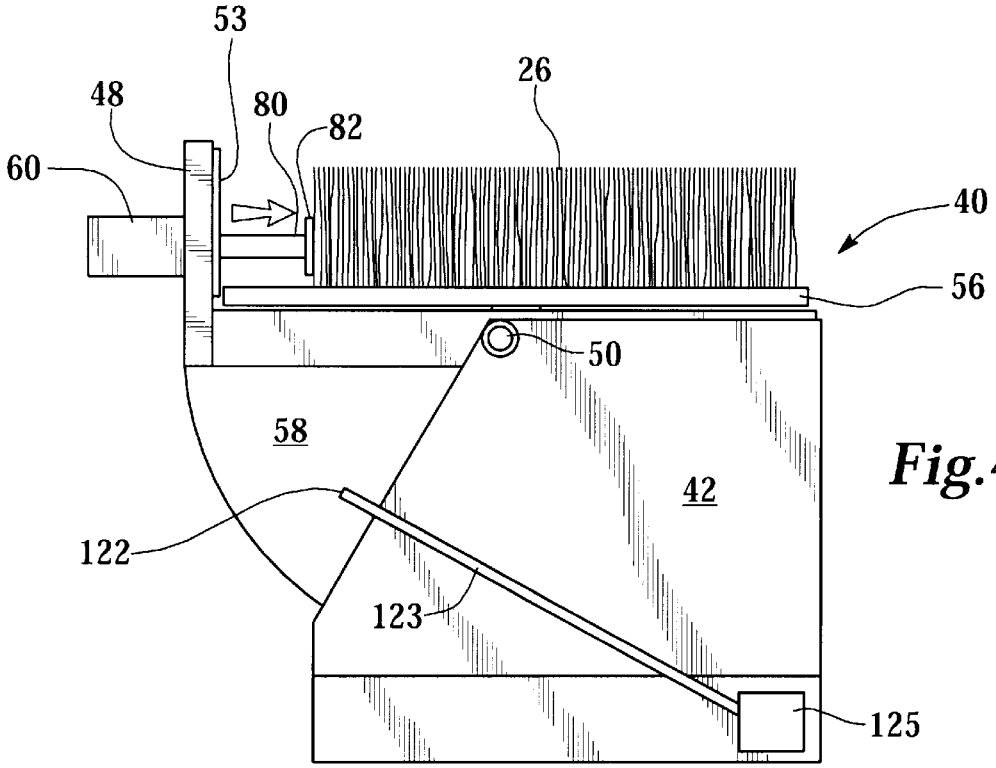
FIG. 4 is a side elevation view of the signature bundle inverter in the tilted position with a bundle end displacement ram moving a bundle of signatures away from a bundle end support.
Figure 5:
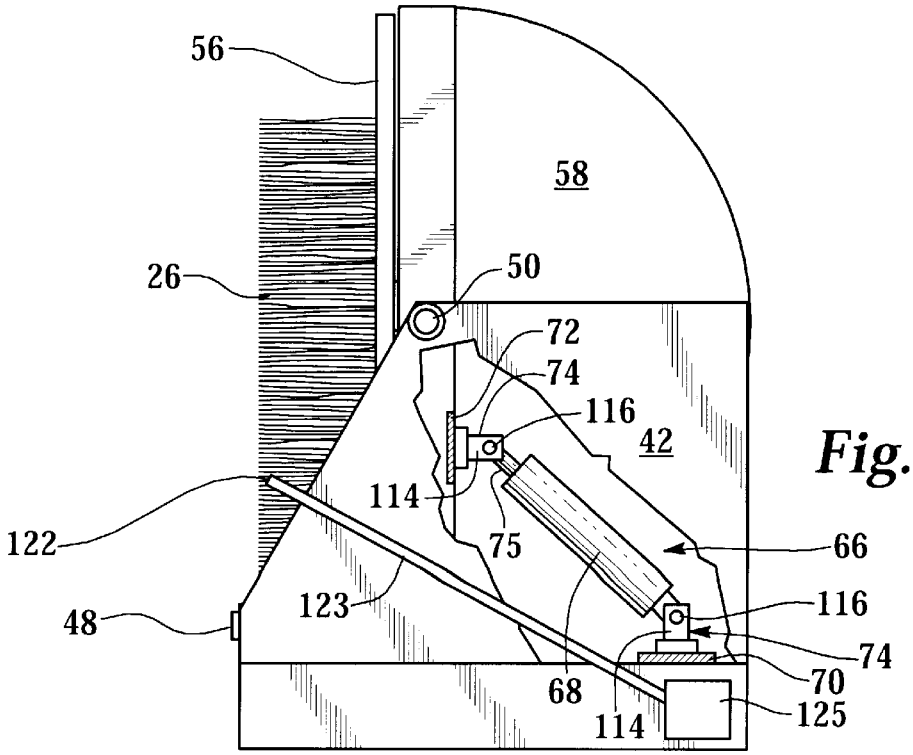
FIG. 5 is a side elevation view of the signature bundle inverter in a hoist-accessible position.

Illustrated in FIGS. 2, 3, and 5 is the signature bundle inverting machine 40 with a portion of the frame 42 broken away to reveal a tilting mechanism 66 that pivots the tilting table 44 between an upright position (FIG. 2), a horizontal position (FIG. 3), and a vertical hoist-accessible position (FIG. 5).It is noted that the hoist-accessible position (FIG. 5) is preferably vertical as illustrated, but can be any position that enables access by a hoist (not illustrated) to reduce the manual labor necessary for removing the signature stack from the inverting machine.

The tilting mechanism 66 includes a pneumatic cylinder 68 joined at its lower end to a base plate 70 and at its upper end to a cross member 72. The pneumatic cylinder 68 is fed by hoses and valves (not illustrated). The pneumatic cylinder 68 includes end pivot connections 74 that accommodate the changing orientation of the tilting table 44 as a piston 75 in the pneumatic cylinder 68 extends and pivots the tilting table 44 from the upright position to the horizontal position.

The cross member 72 must be spaced away from the pivot 50 between the tilting table 44 and the frame 42 to provide a necessary lever arm to be acted on by the force exerted by the pneumatic cylinder 68 to pivot the tilting table 44 from the upright position to the horizontal position.

Once the tilting table 44 is in a horizontal position, the signature bundle 26 will be resting on its side on the rotating portion 56. When in this position, the signature bundle 26 will exert little or no weight on the bundle end support portion 48. Prior to inverting the signature bundle 26, it is desirable to move the signature bundle 26 away from the bundle end support portion 48 so that there is clearance to rotate the signature bundle 26 and so that once the signature bundle 26 has been inverted and the tilting table 44 returns to the upright position, the signature bundle 26 will have a shorter distance to slide before coming to rest on the bundle end support portion 48 of the tilting table 44. Preferably, the signature bundle 26 is moved away from the bundle end support portion 48 by the displacement ram 60 that preferably includes a pneumatic cylinder 80 with an end plate 82.

Figure 6:
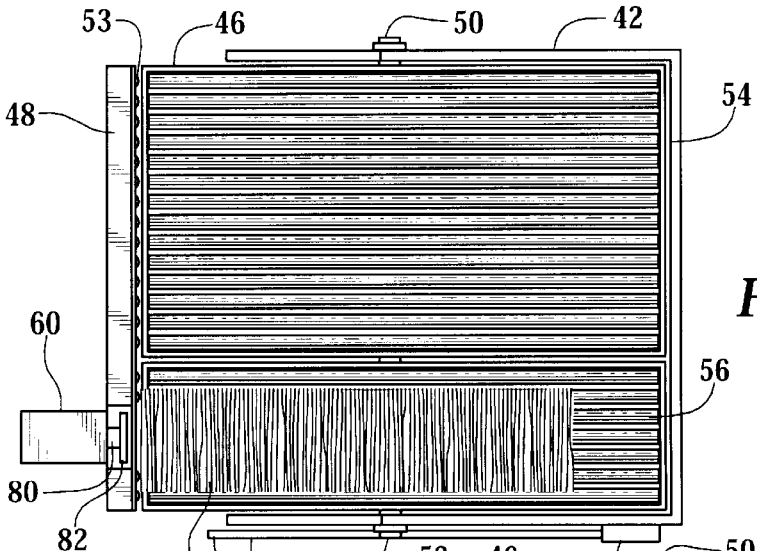
FIG. 6 is a top view of the signature bundle inverter in a tilted position with a signature bundle on a rotating table portion and a signature end displacement ram in a bundle receiving position.
Figure 7:
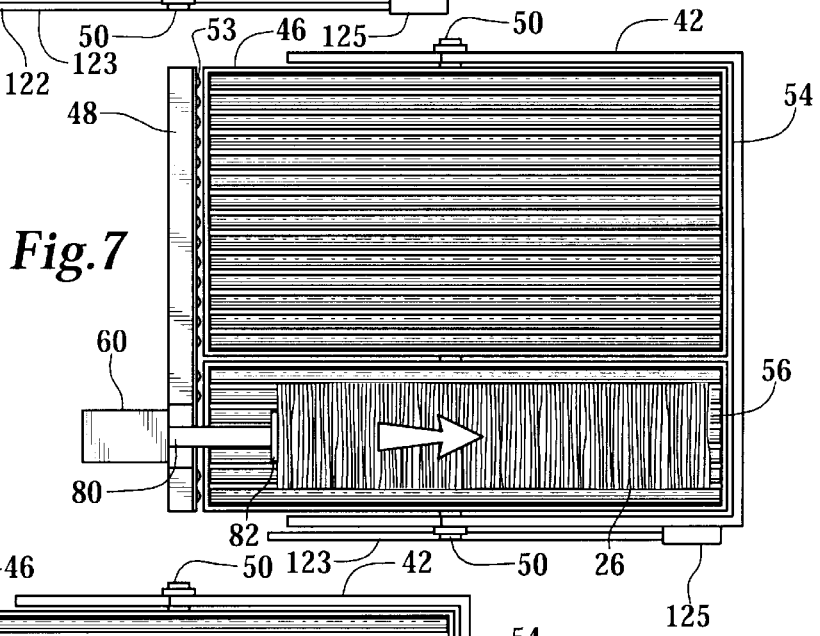
FIG. 7 is the signature bundle inverter of FIG. 6 with the signature end displacement ram pushing the signature bundle away from the bundle end support.
Figure 8:
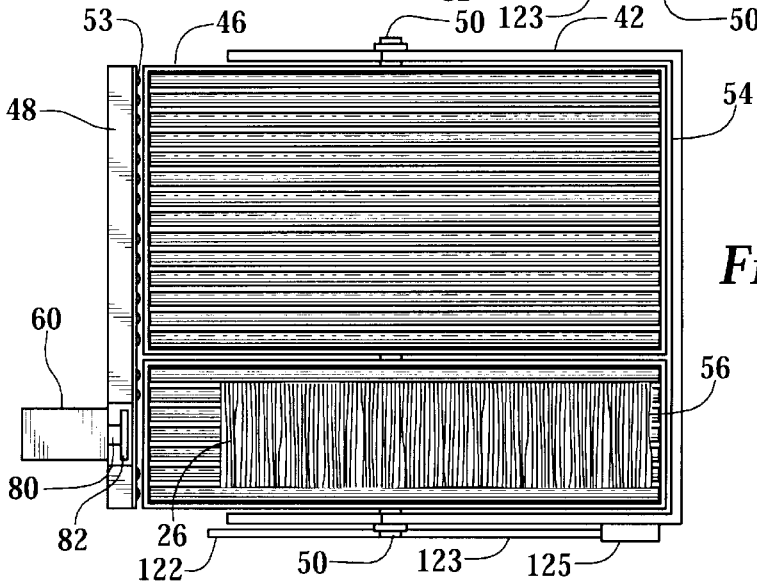
FIG. 8 is the signature bundle inverter of FIGS. 6 and 7 with the signature end displacement ram retracted to its bundle receiving position after displacing a signature bundle away from the bundle end support.

The action of the ram 60 is also illustrated in FIGS.6,7, and 8. In FIG. 6 the tilting table 44 has a signature bundle 26 supported on its rotating table portion 56 and the signature bundle 26 is near the bundle end support portion 48. In FIG. 7, the ram 60 has extended through a gap in the end support rollers 53 and pushed the signature bundle 26 to the right, as illustrated. In FIG. 8, the ram 60 is retracted and the signature bundle 26 remains near the right edge of the table 44.

Figure 9:
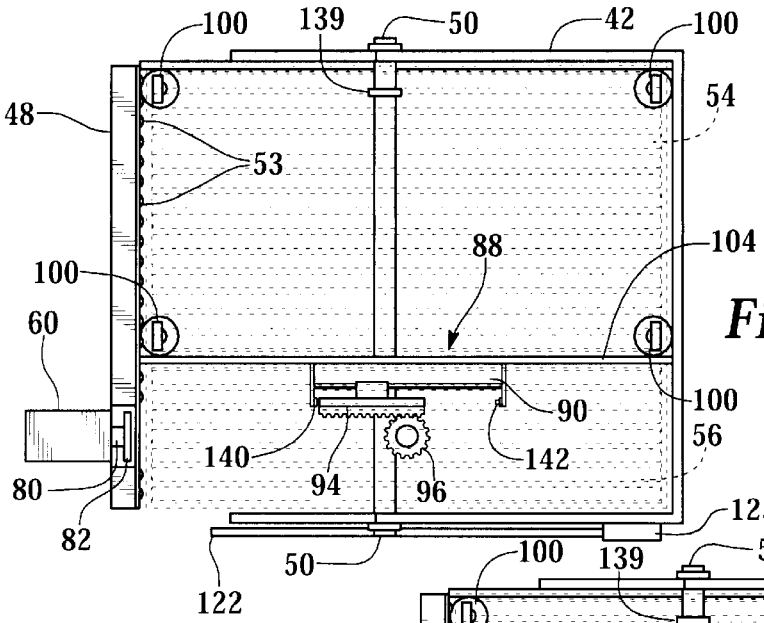
FIG. 9 is a top view of the signature bundle inverter with the bundle edge supporting rollers illustrated in phantom lines to expose a rotating mechanism.
Figure 10:
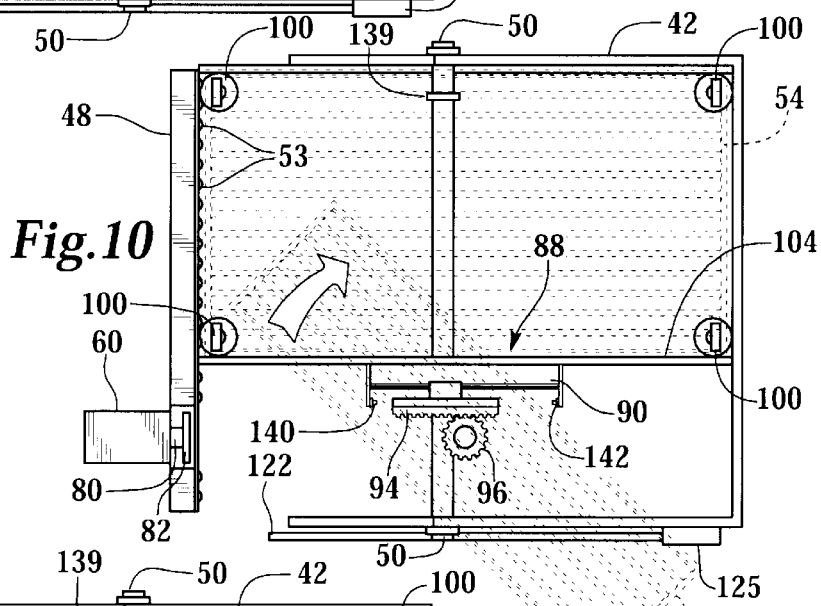
FIG. 10 is the top view of the signature bundle inverter of FIG. 9 with the rotating portion of the table beginning to rotate in response to activation of the rotating mechanism.
Figure 11:
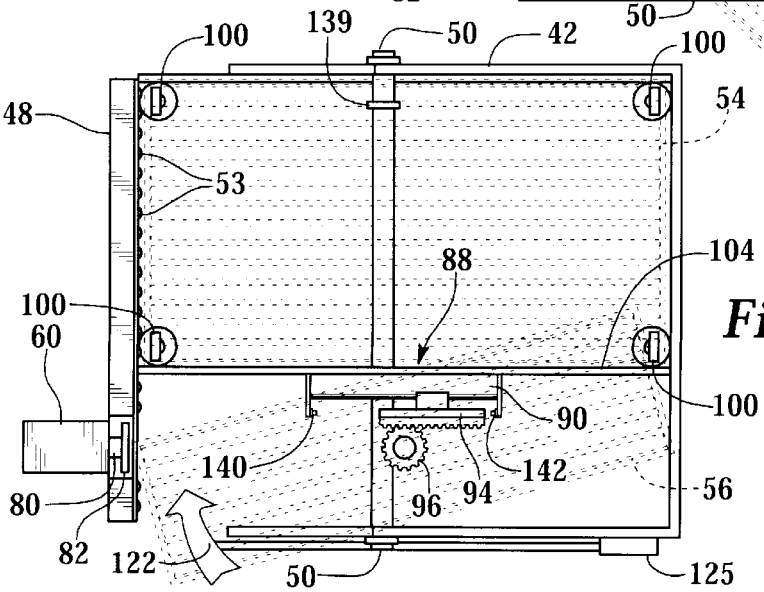
FIG. 11 is the top view of the signature bundle inverter of FIGS. 9 and 10 with the rotating portion of the table near the completion of a bundle inverting rotation.

A mechanism for rotating the rotating table portion 56 is illustrated in FIGS. 9, 10, and 11. The rotating mechanism 88 includes a pneumatic cylinder 90, a piston 92 disposed at least partially inside the pneumatic cylinder 90, a rack 94 fixed to the piston 92, and a pinion gear 96 fixed to the rotating table portion 56. To rotate the rotating table portion 56 180 degrees, the pneumatic cylinder 90 is actuated to move the piston 92 in (right as illustrated) and the rack 94 to the right. Because the rack 94 is meshed with the pinion 96, the pinion 96 rotates clockwise. When the pinion 96 rotates, the rotating table portion 56 also rotates. A single inward movement of the rack 94 rotates the table 56 180 degrees, and a single outward movement of the rack 94 also rotates the table 56 180 degrees. Thus, to invert a signature bundle 26, the rack 94 may move outward or inward depending upon the position of the pneumatic cylinder piston 92 prior to inversion.

Preferably, the cylinder 90 is a Pnue-sa Rodless Cylinder PSA-044X7 manufactured by W. C. Branham, Inc. of Osseo, Minn. and having a seven inch stroke. The rack preferably has a 1.33 pitch such as Model R206X2 manufactured by Martin Sprocket and Gear of Arlington, Tex. The pinion is preferably a Martin TS-624 with a 1.33 pitch supported between two P2B-K-104 R type K bearings 108 (manufactured by Dodge, Inc. of Greenville, S.C.) that are able to carry axial thrust in addition to radial loads. In operation, the cylinder only uses a six inch stroke to avoid the cylinder bottoming out.

Figure 12:
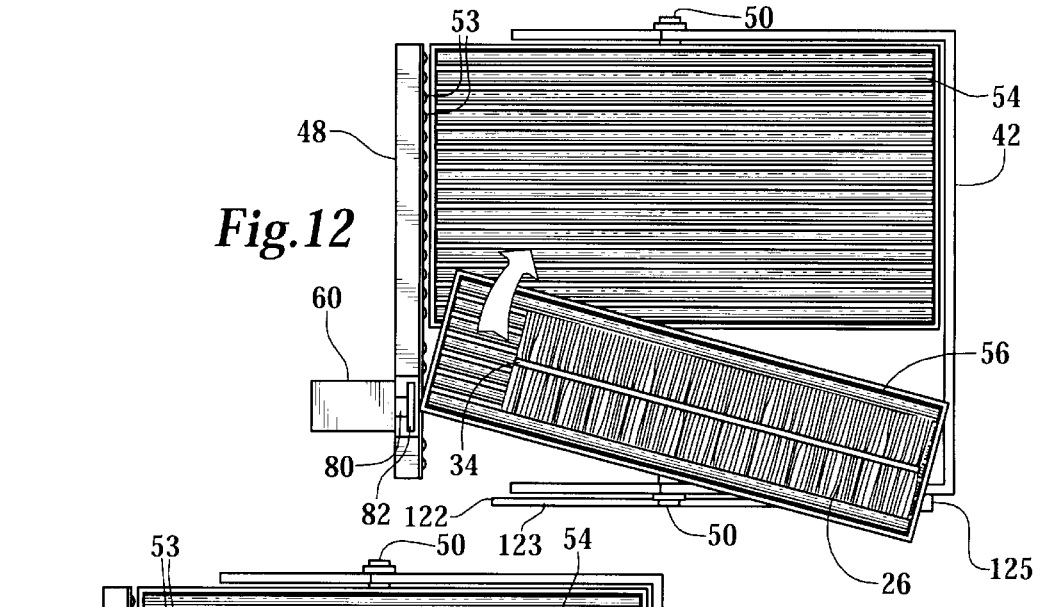
FIG. 12 is a top view of the signature bundle inverter with its rotating table portion beginning to rotate.
Figure 13:
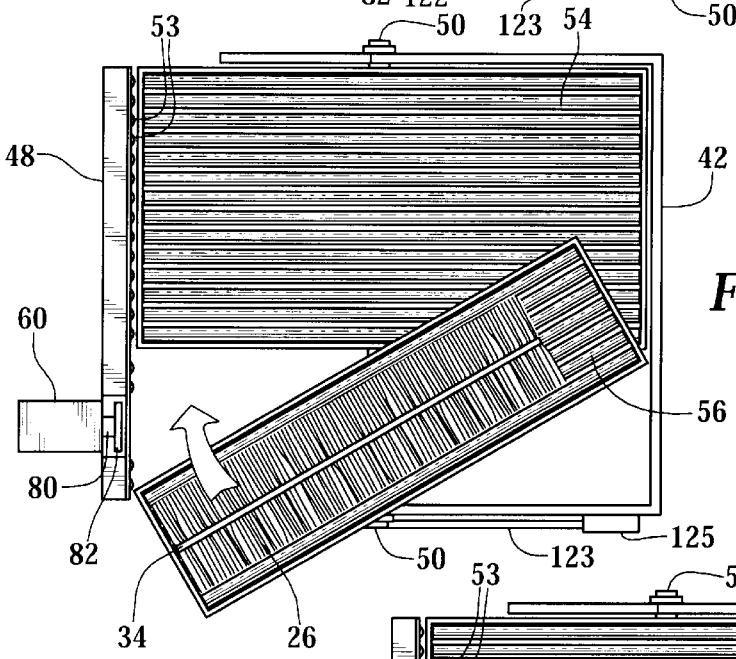
FIG. 13 is a top view of the signature bundle inverter of FIG. 12 with the rotating table nearly completing a bundle inverting rotation.
Figure 14:
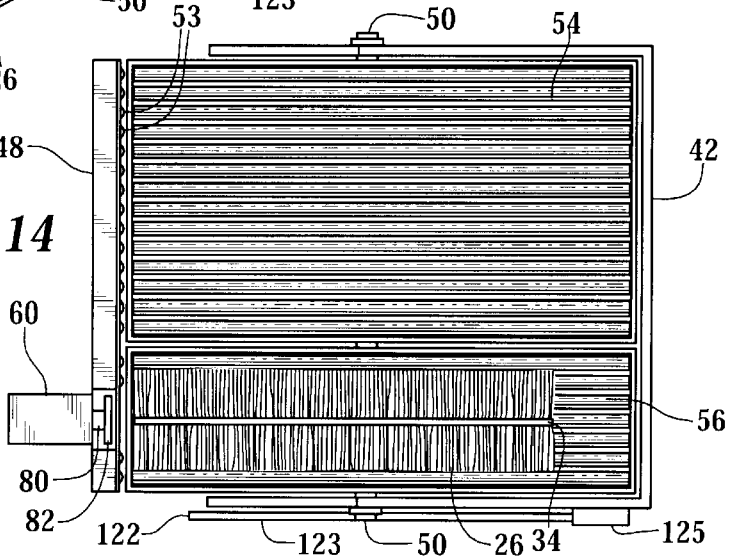
FIG. 14 is a top view of the signature bundle inverter of FIGS. 12 and 13 with the table rotation complete and the opposite end of a signature bundle positioned adjacent to a signature bundle end support.

FIGS. 12,13, and 14 illustrate a signature bundle 26 being inverted after the ram 60 has moved the signature bundle 26 away from the bundle end support portion 48. FIG. 12 illustrates the table beginning to rotate through one half turn or 180 degrees. FIG. 13 illustrates the table rotation when it is nearly complete, and FIG. 14 illustrates the position of the signature bundle 26 at the completion of table rotation. As can be seen in FIG. 14, the signature bundle 26 is close to the bundle end support portion 48 of the tilting table 44 so that when the table 44 returns to an upright position the signature bundle 26 must only move downward a short distance.

Figure 15:
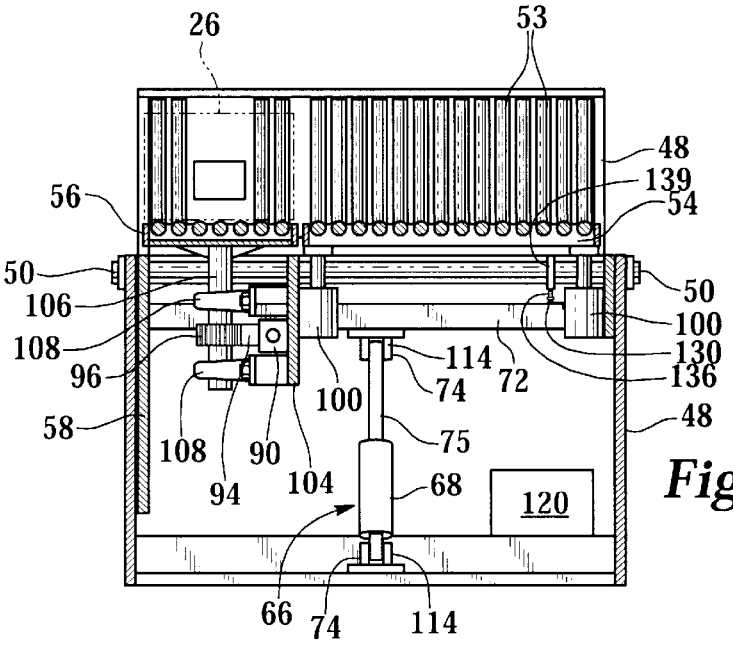
FIG. 15 is a view from the rear of the signature bundle inverter with the table in horizontal position.
Figure 16:
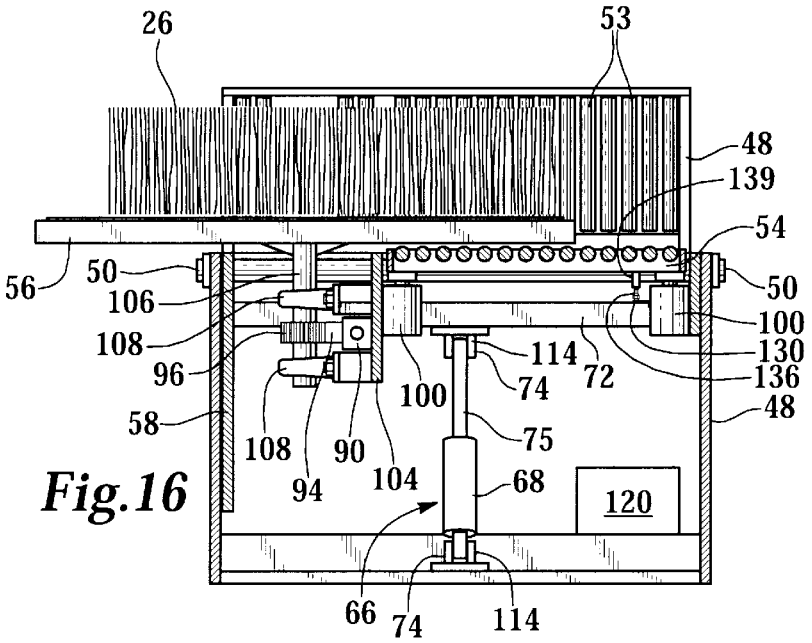
FIG. 16 is the view from the rear of the signature bundle inverter of FIG. 15 with the rotating table halfway through a bundle inverting rotation and supporting a signature bundle.

To provide clearance for the rotating table portion 56 while being rotated, the reciprocating table portion 54 is preferably lowered from a first upper position as illustrated in FIG. 15 to a lower position as illustrated in FIG. 16 using four pneumatic cylinders 100 as illustrated in FIGS. 9,10, 11, 15, and 16.

Also illustrated in FIGS. 15 and 16 are details regarding the construction of the rotating mechanism 88 as well as the tilting mechanism 66. Rotating mechanism 88 includes the pneumatic cylinder 90 fixed to a vertical plate 104 extended downward from the rotating table portion 56. The rack 94 is spaced slightly to the left of pneumatic cylinder 90 and is meshed with the pinion 96. The pinion 96 is fixed to the rotating table portion 56 by a cylindrical shaft 106 that is supported in a pair of pillow blocks 108. The upper end of the cylindrical shaft 106 is reinforced with at least a pair of triangular flanges 110.

The tilting mechanism 66 as illustrated in FIGS. 15 and 16 shows that the pivot connections 74 each comprise a yoke 114 which is joined to the end of the pneumatic cylinder 68 using a suitable pin 116 (FIGS. 2 and 6).

With the signature bundle inverter 40 described above it will be apparent that a signature bundle 26 will be dropped onto a receiving rack 24 of a stacking machine 20, bound with a strap 34, and rolled to the signature bundle inverter 40 at a position to the far right side where the signature bundle 26 side is being supported by the rotating table portion 56.

A programmable logic controller 120 (FIGS. 15 and 16) is activated by an operator and the tilting mechanism 66 moves the tilting table 44 from the upright position to the horizontal position. Either another switch (not illustrated) or the programmable logic controller (PLC) or other suitable data processor, then activates the bundle end displacement ram 60 to push the bundle 26 toward the rear of the inverter 40. Next, the reciprocating table portion 54 is lowered using pneumatic cylinders 100 activated manually or automatically to provide clearance for the rotating table 56 which will rotate 180 degrees by action of the rotating mechanism 88.

Once the rotation is complete, the reciprocating table portion 54 is returned to its upper position and the table 44 is tilted first to the hoist-accessible position (FIG. 5) and then back to its upright position to lower the bundle 40 back to an upright position for transport to a binding machine (FIG. 3).

It is to be understood that the inverting machine 40 can be arranged to be positioned to the left of the signature stacking machine 20 with the above-described elements arranged in essentially the mirror image of the illustrated elements. In fact, other arrangements are possible so long as the rotating table portion 56 is spaced away from the stacking machine 20 a distance adequate to provide clearance for rotation.

As stated above, it is preferable to control the movements of the signature bundle inverter using a programmable logic controller (PLC) 120 (FIG. 1). When the signature bundle inverter 40 is in the upright position (FIG. 2), an operator activates the PLC 120 by pressing a control button that may be on the stacker control panel 22. The operator then moves a signature bundle 26 from the stacking machine 20 to the signature bundle inverter 40, adjacent to rotating table portion 56. When the signature bundle 26 is within one and one-half inches from a photo-electric eye 122, a signal generated by the photo-electric eye 122 will be received by the PLC 120 which will in turn, activate a solenoid valve (not illustrated) that activates the pneumatic cylinder 68 to tilt the table 44 toward the rotating position. A suitable photo-electric eye 122 for sensing a bundle is Model Q10AN60 available from Banner Engineering, Corp., Minneapolis, Minn. and is in communication with the PLC 120 via wiring run through a conduit 123 and a junction box 125.

Figure 17:
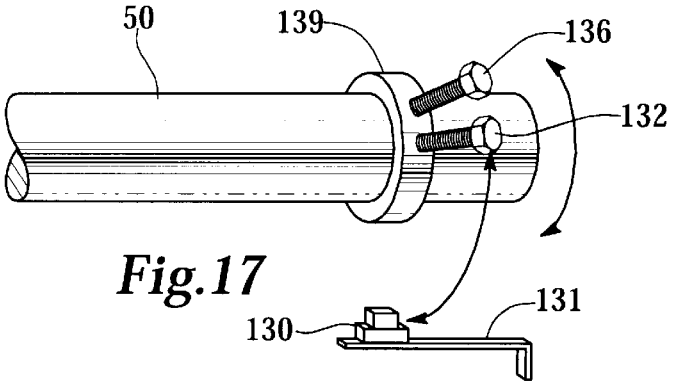
FIG. 17 is a partial perspective view of a table pivot shaft and a position sensor.

As the table 44 nears the rotating position, a flag sensor 130 (FIGS. 15 and 17) mounted on the frame 42 with a bracket 131 senses a first flag 132 mounted on the pivot shaft 50 and signals the PLC 120 to activate a second solenoid valve (not illustrated) which in turn activates the bundle end ram 60 to push the signature bundle 26 away from the bundle end support portion 48. As the table 44 reaches the rotated position (FIG. 3), the flag sensor 130 senses a second flag 136 mounted on the pivot shaft 50 and signals the PLC 120 to activate a third solenoid valve (not illustrated) which in turn activates the rotating mechanism 88. Suitable "flags" can be bolts threaded to a collar 139 on the pivot shaft 50 (FIG. 17). A suitable flag sensor is Model E2E-X5MEI, available from Omron Tateisi Electronic Co. of Japan.

As stated above, the rotating mechanism 88 is connected to a rack 94 which is moved in and out by the hydraulic cylinder 90. To monitor the movement of the rack 94, a pair of turn sensors 140 and 142 (FIGS. 9 to 11) are mounted on the vertical plate 104 at a distance slightly greater than the length of the rack 94 so that only one turn sensor at a time can sense the rack 94. For example, when the rack 94 is spaced away from the pneumatic cylinder 90, turn sensor 140 can sense one end of the rack 94 and signal the PLC 120 of the rack 94 position. As the rack 94 moves toward the hydraulic cylinder 90, turn sensor 140 signals the PLC 120 that the rack 94 has moved and when the rack 94 reaches the limit of its movement toward the hydraulic cylinder 90, turn sensor 142 signals the PLC 120 that the rack 94 has completed its range of movement. Similarly, the turn sensors 140 and 142 will signal the PLC 120 when the rack 94 is moving in the opposite direction. When the PLC 120 receives signals that the rack 94 has completed its movement (and consequently the rotating portion of the table 56 has rotated 180 degrees) the PLC 120 will activate the solenoid valve which causes the table 44 to pivot downward toward the upright position (FIG. 2) or more preferably toward the hoist-access position (FIG. 5). Suitable turn sensors are the Omron sensors described above.

When the signature bundle 26 is removed from the signature bundle inverting machine 40 the electric eye 122 signals the PLC 120 that the bundle 26 is no longer present and activates the solenoid valve to return the pneumatic cylinder 68 and the table 44 to the upright position (FIG. 2).

As a safety feature, the pneumatic cylinder used to tilt the table are fed by a pair of flow control valves for each of the three above-described movements of the table. Depending upon the motion of the table, a particular pair of valves will be used so that the PLC 120 merely needs to activate the valves rather than control operating times, for example. The pairs of valves are arranged in series or end-to-end so that one of the valves is always metering air regardless of which direction air is flowing for that particular table movement. Thus, air is metered both as it is fed to and exhausted from the control valves to provide controlled cylinder movement in both directions. Further, the flow control valves are connected directly to the pneumatic cylinders without intervening hoses to avoid the event of a hose breaking at a point between the valves and the cylinder and thereby losing the benefit of a controlled table movement which could cause property damage or personal injury. Suitable flow control valves are Mead Dyla-Trol, Model MF1-125 manufactured by Mead, U.S.A. of Chicago, Ill.

The foregoing detailed description of drawings is provided for clearness of understanding only and no unnecessary limitations therefrom should be read into the following claims.

I claim:

1. A signature bundle inverter comprising:

a frame, a table pivotably mounted on the frame for movement between a first bundle receiving position and a second bundle rotation position, and having a bundle end support comprising a plurality of bundle end rollers and a bundle side support;

an actuator for pivoting the table between the first position and the second position; and a table rotating mechanism for rotating the bundle side support of the table 180 degrees relative to the bundle end support.

2. A signature bundle inverter comprising:

a frame, a table pivotably mounted on the frame for movement between a first bundle receiving position and a second bundle rotation position, and having a bundle end support and a bundle side support comprising a plurality of bundle side rollers;

an actuator for pivoting the table between the first position and the second position; and a table rotating mechanism for rotating the bundle side support of the table 180 degrees relative to the bundle end support.

3. A signature bundle inverter comprising:

a frame, a table pivotably mounted on the frame for movement between a first bundle receiving position and a second bundle rotation position, and having a bundle end support and a bundle side support;

an actuator for pivoting the table between the first position and the second position; and a table rotating mechanism for rotating the bundle side support of the table 180 degrees relative to the bundle end support:

wherein the table bundle side support comprises:

a reciprocating portion for movement between a first position and a second position;

a rotating portion that is co-planar with the reciprocating portion when in the first position and operatively mounted to the frame for rotating movement relative to the frame and the reciprocating portion with the reciprocating portion in the second position; and an actuator for moving the reciprocating portion between the first position and second position.

4. A signature bundler inverter comprising:

a frame;

a table pivotably mounted on the frame for movement between a first bundle receiving position, a second bundle rotation position, and a hoist-accessible position, and having a bundle end support and a bundle side support:;

an actuator for pivoting the table between the first position and the second position;

a table rotating mechanism for rotating the bundle side support of the table 180 degrees relative to the bundle end support;

a programmable logic controller in operating communication with the signature bundle inverter and having sensor signal inputs and solenoid valve controlling outputs;

a bundle position sensor in bundle sensing communication with the table and in communication with the programmable logic controller;

a first solenoid valve in communication with the programmable logic controller;

a pneumatic cylinder in fluid communication with the first solenoid valve and in operative engagement with the table;

a first table position sensor in communication with the programmable logic controller;

a second solenoid valve in communication with the programmable logic controller and a bundle end displacement ram;

a second table position sensor in communication with the programmable logic controller;

a third solenoid valve in communication with the programmable logic controller and the table rotating mechanism; and a table rotation sensor in communication with the programmable logic controller.

5. A signature bundle inverter comprising:

a frame;

a table pivotably mounted to the frame at a pivot point for movement between an upright position and a horizontal position, and having a bundle end receiving portion comprising a plurality of bundle end receiving rollers, a first bundle side supporting portion, and a rotatable second bundle side supporting portion;

an actuator mounted to the frame and the table for pivoting the table between the upright position and the horizontal position;

a bundle end displacement ram operatively mounted to the table bundle end receiving portion for movement between a bundle receiving position and a bundle displaced position; and a rotating mechanism operatively mounted to the rotatable second bundle side supporting portion.

6. A signature bundle inverter comprising:

a frame;

a table pivotably mounted to the frame at a pivot point for movement between an upright position and a horizontal position, and having a bundle end receiving portion, a first bundle side supporting portion, and a rotatable second bundle side supporting portion, wherein said first and second bundle side supporting portions comprise a plurality of bundle side supporting rollers;

an actuator mounted to the frame and the table for pivoting the table between the upright position and the horizontal position;

a bundle end displacement ram operatively mounted to the table bundle end receiving portion for movement between a bundle receiving position and a bundle displaced position; and a rotating mechanism operatively mounted to the rotatable second bundle side supporting portion.

7. A signature bundle inverter comprising:

a frame, a table pivotably mounted to the frame at a pivot point for movement between an upright position and a horizontal position, and having a bundle end receiving portion, a first bundle side supporting portion, and a rotatable second bundle side supporting portion wherein the first bundle side supporting portion is operatively mounted to the frame for movement between a first position co-planar with the second bundle side supporting portion, and a second position;

an actuator mounted to the frame and the table for pivoting the table between the upright position and the horizontal position;

a bundle end displacement ram operatively mounted to the table bundle end receiving portion for movement between a bundle receiving position and a bundle displaced position; and a rotating mechanism operatively mounted to the rotatable second bundle side supporting portion.

8. The signature bundle inverter of claim 7, wherein the first bundle side supporting portion comprises an actuator for moving the first bundle side supporting portion between the first position and the second position.

9. A signature bundle inverter comprising:

a frame a table pivotably mounted to the frame at a pivot point for movement between an upright position and a horizontal position, and having a bundle end receiving portion, a first bundle side supporting portion, and a rotatable second bundle side supporting portion;

an actuator mounted to the frame and the table for pivoting the table between the upright position and the horizontal position;

a bundle end displacement ram operatively mounted to the table bundle end receiving portion for movement between a bundle receiving position and a bundle displaced position; and a rotating mechanism operatively mounted to the rotatable second bundle side supporting portion, wherein the rotating mechanism comprises:

a pneumatic cylinder fixed to the first bundle side supporting portion having a reciprocating piston;

a rack fixed to the pneumatic cylinder reciprocating piston; and a pinion fixed to the second rotatable bundle side supporting portion and meshed with the rack.

10. A signature bundle inverter comprising:

a frame;

a table pivotably mounted to the frame at a pivot point for movement between an upright position and a horizontal position, and having a bundle end receiving portion, a first bundle side supporting portion, and a rotatable second bundle side supporting portion;

an actuator mounted to the frame and the table for pivoting the table between the upright position and the horizontal position;

a bundle end displacement ram operatively mounted to the table bundle end receiving portion for movement between a bundle receiving position and a bundle displaced position;

a rotating mechanism operatively mounted to the rotatable second bundle side supporting portion;

a programmable logic controller in operating communication with the signature bundle inverter and having sensor signal inputs and solenoid valve controlling outputs;

a bundle position sensor in bundle sensing communication with the table and in communication with the programmable logic controller;

a first solenoid valve in communication with the programmable logic controller;

a pneumatic cylinder in fluid communication with the first solenoid valve and in operative engagement with the table;

a first table position sensor in communication with the programmable logic controller;

a second solenoid valve in communication with the programmable logic controller output and the bundle end displacement ram;

a second table position sensor in communication with the programmable logic controller;

a third solenoid valve in communication with the programmable logic controller and the table rotating mechanism; and a table rotation sensor in communication with the programmable logic controller.

* * * * *